US007701433B2

(12) United States Patent
Iida et al.

(10) Patent No.: US 7,701,433 B2
(45) Date of Patent: Apr. 20, 2010

(54) DISPLAY DEVICE

(75) Inventors: Haruhisa Iida, Chiba (JP); Mamoru Yamanaka, Mobara (JP); Yukihide Ode, Mobara (JP); Shinji Yasukawa, Shirako (JP)

(73) Assignee: Hitachi Displays, Ltd., Mobara-shi (JP)

( * ) Notice: Subject to any disclaimer, the term of this patent is extended or adjusted under 35 U.S.C. 154(b) by 774 days.

(21) Appl. No.: 11/515,821

(22) Filed: Sep. 6, 2006

(65) Prior Publication Data

US 2007/0063960 A1 Mar. 22, 2007

(30) Foreign Application Priority Data

Sep. 6, 2005 (JP) ..... 2005-257590

(51) Int. Cl.
*G09G 3/36* (2006.01)

(52) U.S. Cl. ..... 345/100

(58) Field of Classification Search ..... 345/87–104, 345/204; 377/64–81, 54
See application file for complete search history.

(56) References Cited

U.S. PATENT DOCUMENTS 5,966,115 A * 10/1999 Aoki ..... 345/204
2002/0033790 A1 * 3/2002 Sato et al. ..... 345/90

* cited by examiner

*Primary Examiner*—Amr Awad
*Assistant Examiner*—Kenneth Bukowski
(74) *Attorney, Agent, or Firm*—Antonelli, Terry, Stout & Kraus, LLP.

(57) ABSTRACT

A display device includes a plurality of pixels and drive circuits which drive the plurality of pixels, wherein each drive circuit includes a first input/output terminal, a second input/output terminal, a scanning-direction changeover terminal, and a position designation terminal. In response to a voltage applied to the position designation terminal and a scanning-direction control signal applied to the scanning-direction changeover terminal, the scanning direction is switchable between the first scanning direction which acquires a start pulse from the first input/output terminal and outputs the start pulse from the second input/output terminal and the second scanning direction which acquires the start pulse from the second input/output terminal and outputs the start pulse from the first input/output terminal.

17 Claims, 9 Drawing Sheets

FIG. 4

| LOC1 | LOC2 | SHL | EIO1 | EIO2 | Y1→Yn/Yn→Y1 |
|---|---|---|---|---|---|
| H | H | H | IN | OUT | Y1→Yn |
| H | L | H | IN | OUT | Y1→Yn |
| L | H | H | IN | Hi-z | Y1→Yn |
| H | H | L | OUT | IN | Yn→Y1 |
| H | L | L | Hi-z | IN | Yn→Y1 |
| L | H | L | OUT | IN | Yn→Y1 |

DISPLAY DEVICE

CLAIM OF PRIORITY

The present application claims priority from Japanese application serial No. 2005-257590,filed on (Sep. 6, 2005), the content of which is hereby incorporated by reference into this application.

BACKGROUND OF THE INVENTION

1. Field of the Invention

The present invention relates to a display device, and more particularly to a display device which is easily capable of performing an inversion display in the vertical direction as well as in the lateral direction.

2. Description of the Related Art

In a conventional liquid crystal display device, the direction of an image displayed on a liquid crystal display panel is generally fixed.

However, when the direction of the image displayed on the liquid crystal display panel is inverted laterally and/or vertically, it is possible to provide various mounting modes to the liquid crystal display panel.

In this case, to realize the inversion of the image displayed on the liquid crystal display panel in the lateral direction as well as in the vertical direction, a driver (a drain driver or a gate driver) is required to possess a scanning-direction changeover function and a start pulse input-direction changeover function.

Although the former function can be obtained by controlling a voltage level of a signal inputted to the driver, to obtain the latter function, it is necessary to changeover an external switch in determining one of input and output terminals which are arranged on left and right sides of the driver to which the start pulse is inputted. (see JP-A-10-207430)

SUMMARY OF THE INVENTION

FIG. 12 is a block diagram showing the schematic constitution of one example of a conventional drain driver having a scanning-direction changeover function. Here, in FIG. 12, only the constitution relevant to the scanning-direction changeover function is illustrated.

In FIG. 12, numeral 100 indicates a drain driver, numeral 101 indicates a scanning control circuit, numeral 102 indicates a two-way scanning circuit, numeral 103 indicates an output circuit, numeral 200 indicates a switching part, symbols SW1, SW2 indicate switching circuits, and symbols BA1 to BA4 indicate buffer circuits.

In the drain driver 100 shown in FIG. 12, based on a voltage level of a scanning-direction control signal applied to a scanning-direction changeover terminal (SHL), the scanning control circuit 101 controls the switching circuits (SW1, SW2) so as to changeover the input/output relationship of input and output terminals (EIO1, EIO2) of the start pulse which are arranged at left and right sides.

For example, when the scanning direction control signal applied to the scanning-direction changeover terminal (SHL) assumes a Low level (hereinafter, referred to as L level), the scanning control circuit 101, as shown in FIG. 12, controls the switching circuit (SW1) so as to connect the input/output terminal (EIO2) and the buffer circuit (BA4) and, at the same time, to connect the input/output terminal (EIO1) and the buffer circuit (BA1). Due to such a constitution, a start pulse is inputted from the input/output terminal (EIO2) and is outputted from the input/output terminal (EIO1).

Further, when the scanning direction control signal applied to the scanning-direction changeover terminal (SHL) assumes a High level (hereinafter, referred to as H level), the scanning control circuit 101 controls the switching circuit (SW1) so as to connect the input/output terminal (EIO2) and the buffer circuit (BA3) and, at the same time, to connect the input/output terminal (EIO1) and the buffer circuit (BA2). Due to such a constitution, the start pulse is inputted from the input/output terminal (EIO1) and is outputted from the input/output terminal (EIO2).

Here, unless the changeover of the switching part 200 is performed in response to the voltage level of the scanning control signal applied to the scanning-direction changeover terminal (SHL), the start pulse is not inputted to the drain driver 100 and hence, a normal operation is not performed.

Accordingly, the constitution shown in FIG. 12 has a drawback that it is necessary to provide the switching part 200 for inputting the start pulse at the input/output terminal (EIO1) or the input/output terminal (EIO2) outside the drain driver 100.

The present invention has been made to overcome the above-mentioned drawback of the related art, and it is an object of the present invention to provide a technique which, in a display device, can easily realize the inversion of an image displayed on a display panel in the lateral direction as well as in the vertical direction without requiring an external switching part for changing over a start pulse, the changeover of a signal and the like.

The above-mentioned object, other objects and novel features of the present invention will become apparent from the description of this specification and attached drawings.

To briefly explain the summary of typical inventions among inventions disclosed in this specification, they are as follows.

To overcome the above-mentioned drawback, the present invention provides a display device which includes a plurality of pixels and drive circuits which drive the plurality of pixels, wherein each drive circuit includes a first input/output terminal, a second input/output terminal, a scanning-direction changeover terminal, and a position designation terminal, in response to a voltage applied to the position designation terminal and a scanning-direction control signal applied to the scanning-direction changeover terminal, the first scanning direction is switchable between the first scanning direction which acquires a start pulse from the first input/output terminal and outputs the start pulse from the second input/output terminal and the second scanning direction which acquires the start pulse from the second input/output terminal and outputs the start pulse from the first input/output terminal.

Further, according to the present invention, each drive circuit includes a scanning control circuit and a two-way scanning circuit, the scanning control circuit, in response to the voltage applied to the position designation terminal and the scanning-direction control signal applied to the scanning direction changeover terminal, at the time of performing scanning in the first scanning direction, inputs the start pulse which is inputted to the first input/output terminal to the two-way scanning circuit and, at the same time, outputs the start pulse which is scanned in the inside of the two-way scanning circuit from the second input/output terminal, and at the time of performing scanning in the second scanning direction, inputs the start pulse which is inputted to the second input/output terminal to the two-way scanning circuit and, at the same time, outputs the start pulse which is scanned in the inside of the two-way scanning circuit from the first input/output terminal.

Further, according to the present invention, the position designation terminal includes a first position designation terminal and a second position designation terminal, the drive circuit, when a first voltage at a first voltage level is applied to the first position designation terminal and the second position designation terminal and a scanning-direction control signal applied to the scanning-direction changeover terminal assumes a High level, acquires the start pulse from the first input/output terminal and outputs the start pulse from the second input/output terminal, and the drive circuit, when the first voltage is applied to the first position designation terminal and the second position designation terminal and a scanning direction control signal applied to the scanning-direction changeover terminal assumes a Low level, acquires the start pulse from the second input/output terminal and outputs the start pulse from the first input/output terminal.

Further, according to the present invention, the position designation terminal includes a first position designation terminal and a second position designation terminal, the drive circuit, when a second voltage at a second voltage level is applied to the first position designation terminal and, at the same time, a first voltage at a first voltage level is applied to the second position designation terminal, and the scanning-direction control signal applied to the scanning-direction changeover terminal assumes a High level, acquires the start pulse from the first input/output terminal and brings the second input/output terminal into a high impedance state, and the drive circuit, when the second voltage is applied to the first position designation terminal and, at the same time, the first voltage is applied to the second position designation terminal, and the scanning-direction control signal applied to the scanning-direction changeover terminal assumes a Low level, acquires the start pulse from the second input/output terminal and outputs the start pulse fromthe first input/output terminal.

Further, according to the present invention, the position designation terminal includes a first position designation terminal and a second position designation terminal, the drive circuit, when a first voltage at a first voltage level is applied to the first position designation terminal and, at the same time, a second voltage at a second voltage level is applied to the second position designation terminal, and the scanning-direction control signal applied to the scanning-direction changeover terminal assumes a High level, acquires the start pulse from the first input/output terminal and outputs the start pulse fromthe second input/output terminal, and the drive circuit, when the first voltage is applied to the first position designation terminal and, at the same time, the second voltage is applied to the second position designation terminal, and the scanning-direction control signal applied to the scanning-direction changeover terminal assumes a Low level, acquires the start pulse from the second input/output terminal and brings the first input/output terminal into a high impedance state.

Further, according to the present invention, in the drive circuit except for the drive circuits which are positioned at both ends among the plurality of the drive circuits, the first voltage is applied to the first position designation terminal and the second position designation terminal, in the drive circuit which is positioned at a leading end in the first scanning direction among the plurality of drive circuits, the second voltage is applied to the first position designation terminal and, at the same time, the first voltage is applied to the second position designation terminal, and in the drive circuit which is positioned at a leading end in the second scanning direction among the plurality of drive circuits, the first voltage is applied to the first position designation terminal and, at the same time, the second voltage is applied to the second position designation terminal.

Further, according to the present invention, the scanning direction of the start pulse assumes the first scanning direction when the scanning-direction control signal assumes the High level, and the scanning direction of the start pulse assumes the second scanning direction when the scanning-direction control signal assumes the Low level.

Further, according to the present invention, the display device includes a plurality of video lines which apply a video voltage to the plurality of pixels, the plurality of drive circuits are formed of a video line drive circuit which sequentially acquires display data inputted from the outside and supplies the video voltage corresponding to the acquired display data to the video lines, and the start pulse is a start pulse for starting the acquisition of the display data.

Further, according to the present invention, the display device includes a plurality of scanning lines which apply a selective scanning voltage to the plurality of pixels, the plurality of drive circuits are formed of a scanning line drive circuit which sequentially supplies the selective scanning voltage to the scanning lines, and the start pulse is a start pulse for starting the selection of the scanning line.

To briefly explain advantageous effects obtained by the typical inventions among the inventions disclosed in this specification, they are as follows.

According to the display device of the present invention, it is possible to realize the inversion of an image displayed on a display panel in the lateral direction as well as in the vertical direction without requiring an external switching part for changing over a start pulse, the changeover of a signal and the like.

BRIEF EXPLANATION OF DRAWINGS

FIG. 4 is a table which shows the relationship between voltage levels of voltages applied to position designation terminals (LOC1, LOC2), a voltage level of a scanning-direction control signal which is inputted to a scanning-direction changeover terminal (SHL), a changing-over state between input/output terminals (EIO1, EIO2), and the scanning direction (the shifting direction);

DESCRIPTION OF THE PREFERRED EMBODIMENTS

Hereinafter, embodiments of the present invention are explained in detail in conjunction with drawings.

Here, in all drawings for explaining the embodiments, parts having identical functions are indicated by same symbols and their repeated explanation is omitted.

(The Constitution of Liquid Crystal Display Module which Constitutes a Premise of the Present Invention)

Figure 1:
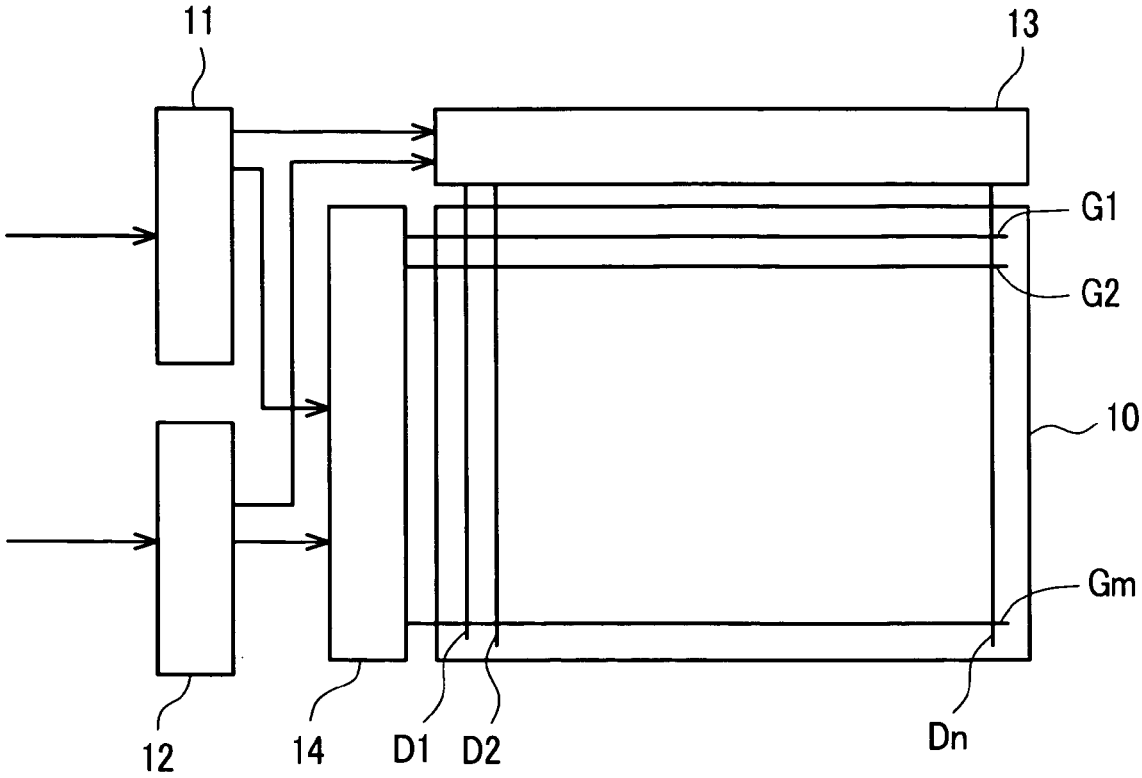
FIG. 1 is a block diagram showing the circuit constitution of a TFT-type liquid crystal display module which constitutes a premise of the present invention.

FIG. 1 is a block diagram showing the circuit constitution of a TFT-type liquid crystal display module which constitutes the premise of the present invention.

The liquid crystal display module shown in FIG. 1 is constituted of a liquid crystal display panel 10, a display control device 11, a power source circuit 12, a drain driver part 13 and a gate driver part 14.

Figure 2:
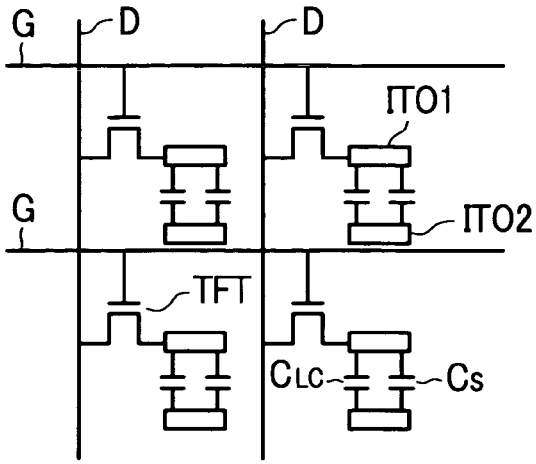
FIG. 2 is a view showing an equivalent circuit of one example of a liquid crystal display panel shown in FIG. 1.

FIG. 2 is a view showing an equivalent circuit of one example of the liquid crystal display panel 10 shown in FIG. 1.

As shown in FIG. 2, the liquid crystal display panel 10 includes a plurality of pixels which are formed in a matrix array.

Each pixel includes a thin film transistor (TFT) and a source electrode of the thin film transistor (TFT) of each pixel is connected to a pixel electrode (ITO1).

Further, a liquid crystal layer is formed between the pixel electrode (ITO1) and a common electrode (also referred to as a counter electrode) (ITO2) and hence, a liquid crystal capacitance (CLC) is equivalently connected between the pixel electrode (ITO1) and the common electrode (ITO2).

Further, between the source electrode of the thin film transistor (TFT) and the common electrode (ITO2), a storage capacitance (CS) is connected.

The drain driver part 13 shown in FIG. 1 is constituted of a plurality of drain drivers, and the gate driver part 14 is constituted of a plurality of gate drivers in the same manner as the drain driver part 13.

In the liquid crystal display panel 10 shown in FIG. 2, the drain electrodes of the thin film transistors (TFT) of the respective pixels which are arranged in the row direction are respectively connected to drain lines (also referred to as video lines) D, and the respective drain lines D are connected to the drain drivers of the drain driver part 13 which applies a gray scale voltage to the liquid crystal of the respective pixels in the row direction.

Further, gate electrodes of the thin film transistors (TFT) in the respective pixels which are arranged in the row direction are connected with the respective gate lines (also referred to as scanning lines) G, and the respective gate lines G are connected to the gate driver of the gate driver part 14 which supplies a scanning drive voltage (a positive bias voltage or a negative bias voltage) to the gate electrodes of the thin film transistors (TFT) of the respective pixels in the row direction for 1 horizontal scanning time.

A display control device 110 controls and drives the drain drivers of the drain driver part 13 and the gate drivers of the gate driver part 14 in response to respective display control signals consisting of a clock signal, a display timing signal, a horizontal synchronizing signal and a vertical synchronizing signal and a display data (R•G•B) which are transmitted from the outside.

The power source circuit 12 supplies a gray scale reference voltage to the respective drain drivers of the drain driver part 13 and, at the same time, supplies the scanning drive voltages to the respective gate drivers of the gate driver part 14, and the power source circuit 12 further supplies a common voltage to the common electrode (ITO2).

Further, the power source circuit 12 supplies power source voltages for respective drivers to the respective drain drivers of the drain driver part 13 and the respective gate drivers of the gate driver part 14.

The respective gate drivers of the gate driver part 14 supply the scanning signal voltages which turn on the thin film transistors (TFT) for 1 horizontal scanning time by every 1 horizontal scanning line to the gate lines G sequentially, and turn on the thin film transistors (TFT).

Further, the respective drain drivers of the drain driver part 13 supply the video signal voltages to the drain lines D, apply the video signal voltages to the pixel electrodes (ITO1) via the thin film transistors (TFT) which are turned on, write the video signal voltages in the respective pixels and charge the liquid crystal capacitance (CLC) between the pixel electrode (ITO1) and the common electrode (ITO2) to the predetermined voltages.

By changing the orientation directions of liquid crystal molecules in the respective pixels based on the charged voltages, an image is displayed.

Due to the above-mentioned operations, the image is displayed on the liquid crystal display panel 100.

Embodiment

Figure 3:
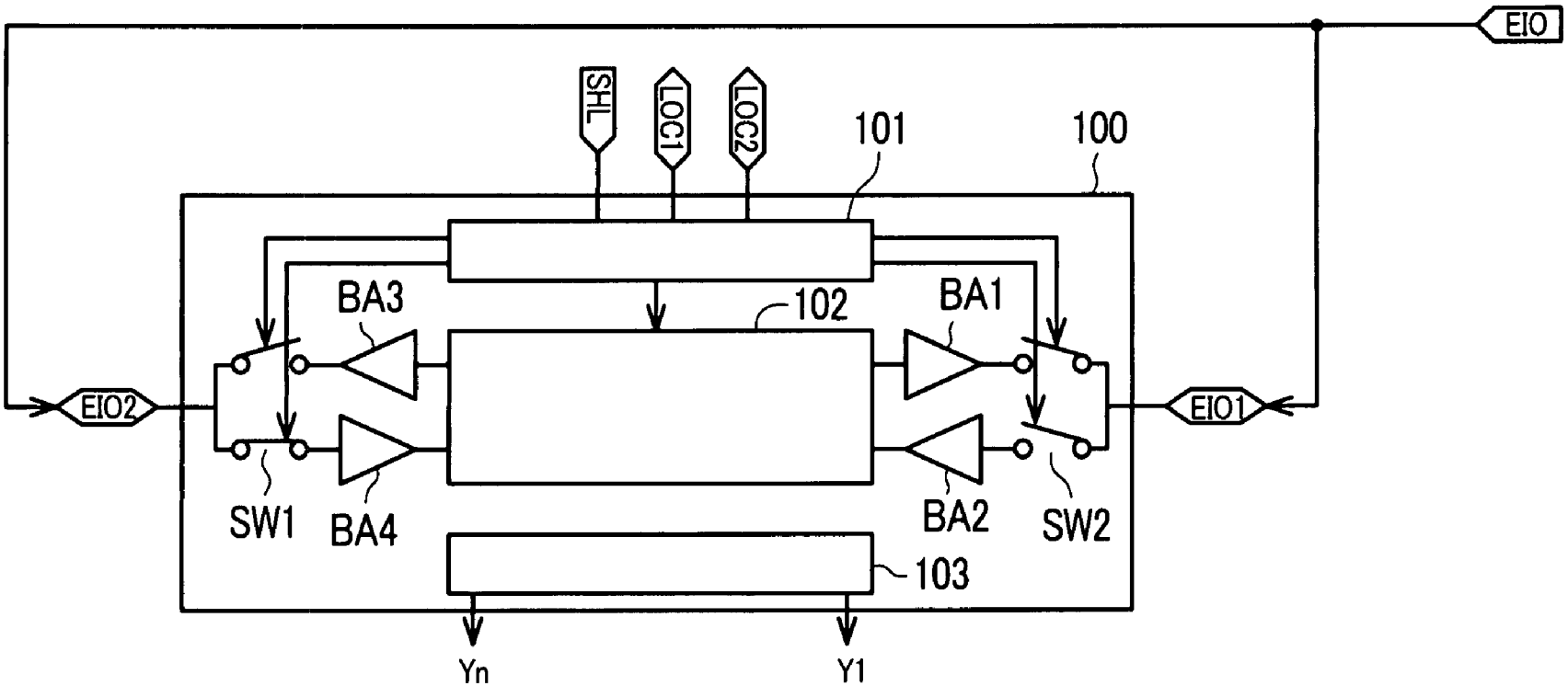
FIG. 3 is a block diagram showing the schematic constitution of a drain driver of an embodiment of the present invention.

FIG. 3 is a block diagram showing the schematic constitution of a drain driver of an embodiment according to the present invention.

In FIG. 3, numeral 100 indicates the drain driver, numeral 101 indicates a scanning control circuit, numeral 102 indicates a two-way scanning circuit, numeral 103 indicates an output circuit, symbols SW1, SW2 indicate switching circuits, and symbols BA1 to BA4 indicate buffer circuits.

In this embodiment, first and second position designation terminals (LOC1, LOC2) for designating positions of the drivers are provided to the display device, and an H-level voltage (for example, a power source voltage of VCC) or an L-level voltage (for example, a ground voltage of GND) are applied to the position designation terminals (LOC1, LOC2).

Further, in this embodiment, the scanning control circuit 101 performs, based on voltage levels of voltages which are inputted to a scanning-direction changeover terminal (SHL) of the driver and the newly provided position designation terminals (LOC1, LOC2), the input/output changeover of input/output terminals of a start pulse for starting the acquisition of display data and the changeover of an operation mode to a high-impedance state.

FIG. 4 is a table which shows the relationship between the voltage levels of voltages applied to the position designation terminals (LOC1, LOC2), the voltage level of a scanning-direction control signal which is inputted to the scanning-direction changeover terminal (SHL), a changeover state between the input/output terminals (EIO1, EIO2), and the scanning direction (the shifting direction).

As indicated by the table shown in FIG. 4, when the voltage which is applied to the position designation terminal (LOC1)

assumes an H level, the voltage which is applied to the position designation terminal (LOC2) assumes an H level, and the scanning-direction control signal which is applied to the scanning-direction changeover terminal (SHL) assumes H level, and also when the voltage which is applied to the position designation terminal (LOC1) assumes the H level, the voltage which is applied to the position designation terminal (LOC2) assumes the L level, and the scanning-direction control signal which is applied to the scanning-direction changeover terminal (SHL) assumes the H level, the scanning control circuit 101 controls the switching circuit (SW1) so as to connect the input/output terminal (EIO2) and the buffer circuit (BA3) to each other and, at the same time, controls the switching circuit (SW2) so as to connect the input/output terminal (EIO1) and the buffer circuit (BA2) to each other.

In this manner, the input/output terminal (EIO1) functions as the input terminal (IN) of the start pulse and the input/output terminal (EIO2) functions as the output terminal (OUT) of the start pulse. In this case, the scanning direction (shifting direction) is directed in the direction from an output terminal (Y1) to an output terminal (Yn).

Further, when the voltage which is applied to the position designation terminal (LOC1) assumes the L level, the voltage which is applied to the position designation terminal (LOC2) assumes H level and the scanning-direction control signal which is applied to the scanning-direction changeover terminal (SHL) assumes the H level, the scanning control circuit 101 controls the switching circuit (SW1) so as to bring the input/output terminal (EIO2) into an open state in which the input/output terminal (EIO2) is not connected to any circuits and, at the same time, the scanning control circuit 101 controls the switching circuit (SW2) so as to connect the input/output terminal (EIO1) and the buffer circuit (BA2) to each other.

In this manner, the input/output terminal (EIO1) functions as the input terminal (IN) of the startpulse, and the input/output terminal (EIO2) assumes a high-impedance state. In this case, the scanning direction (shifting direction) is directed in the direction from the output terminal (Y1) to the output terminal (Yn).

Further, when the voltage which is applied to the position designation terminal (LOC1) assumes the H level, the voltage which is applied to the position designation terminal (LOC2) assumes H level and the scanning-direction control signal which is applied to the scanning-direction changeover terminal (SHL) assumes the L level and also when the voltage which is applied to the position designation terminal (LOC1) assumes the L level, the voltage which is applied to the position designation terminal (LOC2) assumes the H level and the scanning-direction control signal which is applied to the scanning-direction changeover terminal (SHL) assumes the L level, the scanning control circuit 101 controls the switching circuit (SW1) so as to connect the input/output terminal (EIO2) and the buffer circuit (BA4) to each other and, at the same time, the scanning control circuit 101 controls the switching circuit (SW2) so as to connect the input/output terminal (EIO1) and the buffer circuit (BA1) to each other.

In this manner, the input/output terminal (EIO2) functions as the input terminal (IN) of the start pulse and the input/output terminal (EIO1) functions as the output terminal (OUT) of the start pulse. In this case, the scanning direction (shifting direction) is directed in the direction from the output terminal (Yn) to the output terminal (Y1).

Further, when the voltage which is applied to the position designation terminal (LOC1) assumes the H level, the voltage which is applied to the position designation terminal (LOC2) assumes the L level and the scanning-direction control signal which is applied to the scanning-direction changeover terminal (SHL) assumes the L level, the scanning control circuit 101 controls the switching circuit (SW1) so as to connect the input/output terminal (EIO2) and the buffer circuit (BA4) to each other and, at the same time, the scanning control circuit 101 controls the switching circuit (SW2) so as to bring the input/output terminal (EIO1) into an open state in which the input/output terminal (EIO1) is not connected to any circuits.

In this manner, theinput/output terminal (EIO2) functions as the input terminal (IN) of the start pulse, and the input/output terminal (EIO1) assumes a high-impedance state. In this case, the scanning direction (shifting direction) is directed in the direction from the output terminal (Yn) to the output terminal (Y1).

In this embodiment, when the input/output terminals (EIO1, EIO2) assume a high-impedance state, as shown in FIG. 3, even when the start pulse is inputted to both input/output terminals (EIO1, EIO2), there is no possibility that a loop is formed between the input/output terminal (EIO1) and the input/output terminal (EIO2) and hence, the above-mentioned switching part 200 becomes unnecessary.

In this embodiment, due to the provision which preliminarily applies the voltages having predetermined voltage levels to the position designation terminals (LOC1, LOC2), by merely changing over the voltage level of the scanning-direction control signal which is applied to the scanning-direction changeover terminal (SHL) to the H level or the L level, it is possible to perform an inverted display of an image which is displayed on the liquid crystal display panel.

Figure 5:
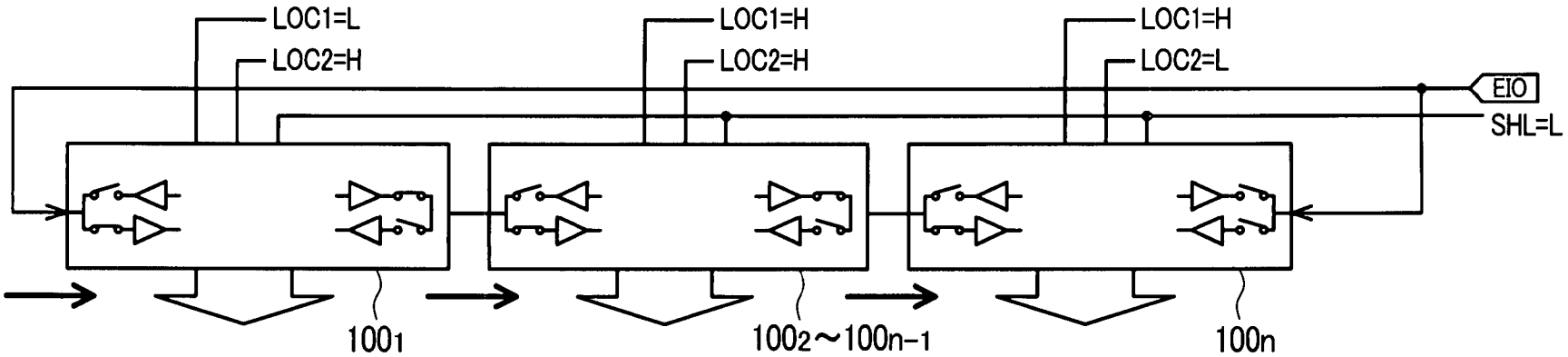
FIG. 5 is a schematic view for explaining a case in which a normal scanning operation is performed using the plurality of drain drivers shown in FIG. 3.
Figure 6:
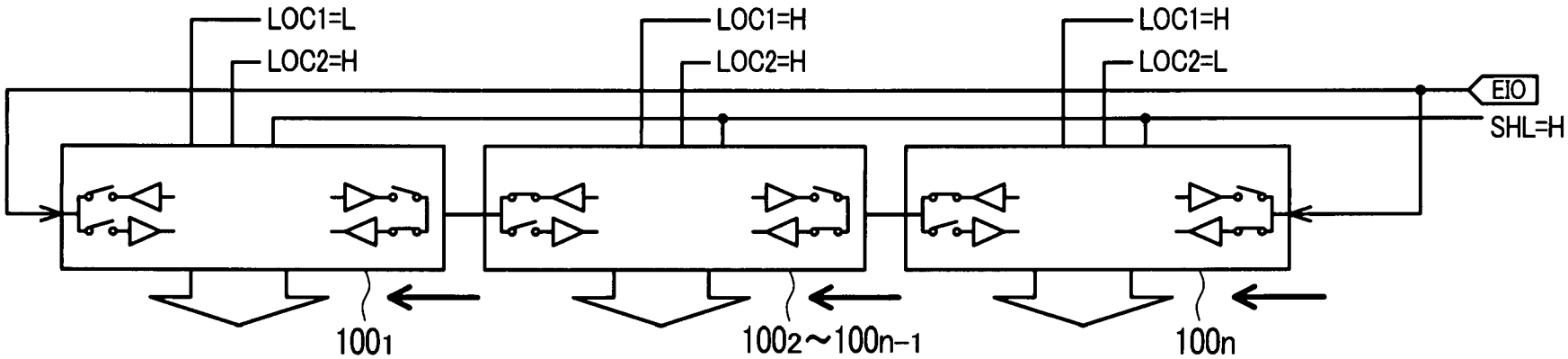
FIG. 6 is a schematic view for explaining a case in which an inverse scanning operation is performed using the plurality of drain drivers shown in FIG. 3.

FIG. 5 is a schematic view for explaining a case in which a normal scanning operation is performed using a plurality of drain drivers shown in FIG. 3, and FIG. 6 is a schematic view for explaining a case in which an inverse scanning operation is performed using a plurality of drain drivers shown in FIG. 3.

In FIG. 5 and FIG. 6, numerals $\mathbf{100}_1$ to $\mathbf{100}_n$ indicate the drain drivers. As shown in these drawings, a voltage which is applied to the position designation terminal (LOC1) of the leftmost-end drain driver $\mathbf{100}_1$ assumes an L level, and a voltage which is applied to the position designation terminal (LOC2) of the leftmost-end drain driver $\mathbf{100}_1$ assumes an H level.

Further, a voltage which is applied to the position designation terminal (LOC1) of the rightmost-end drain driver $\mathbf{100}_n$ assumes an H level, and a voltage which is applied to the position designation terminal (LOC2) of the rightmost-end drain driver $\mathbf{100}_n$ assumes an L level.

Further, voltages which are applied to the position designation terminals (EIO1, EIO2) of the drain drivers ($\mathbf{100}_2$ to $\mathbf{100}^{n-1}$) respectively assume an HL level, respectively.

In such a state, by setting the scanning-direction control signal which is applied to the scanning-direction changeover terminal (SHL) to an L level, the scanning is started from the drain driver $\mathbf{100}_1$, that is, the scanning direction (shifting direction) is directed in the direction from the drain driver $\mathbf{100}_1$ to the drain driver $\mathbf{100}_n$ thus performing the normal display.

Further, in such a state, by setting the scanning-direction control signal which is applied to the scanning-direction changeover terminal (SHL) to an H level, the scanning is started from the drain driver $\mathbf{100}_n$, that is, the scanning direction (shifting direction) is directed in the direction from the drain driver $\mathbf{100}_n$ to the drain driver $\mathbf{100}_1$ thus enabling the display of a laterally-inversed image.

In this case, the control of the mode of operation from the normal scanning operation to the inverted scanning operation or from the inverted scanning operation to the normal scanning operation is performed based on only the voltage level of the scanning-direction control signal applied to the scanning-direction changeover terminal (SHL) and does not require external switches and signals for changing over the start pulse thus realizing an extremely simple inverted display control.

By adopting the above-mentioned position designation terminals (LOC1, LOC2) also in the gate driver, it is possible to perform a vertically-and-laterally miller inverted display of an image which is displayed on the liquid crystal display panel and hence, it is possible to provide various mounting modes of the liquid crystal display panel. Here, when the above-mentioned position designation terminals (LOC, LOC2) are adopted by the gate drivers, the start pulse becomes a start pulse (frame start signal) for starting the selection of the scanning lines.

Figure 7:
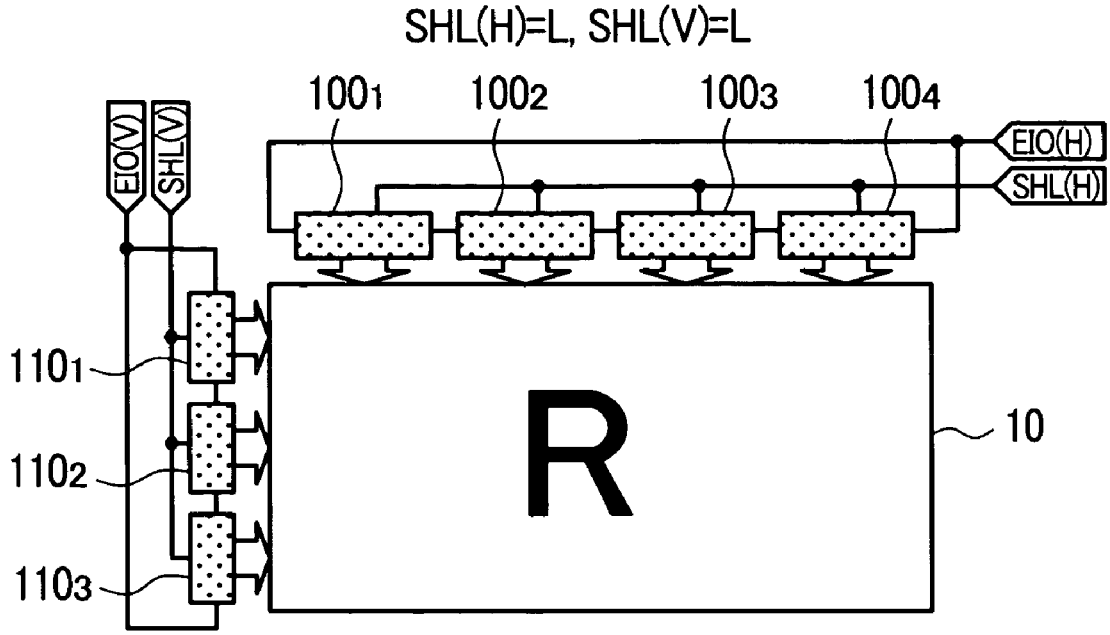
FIG. 7 is a view showing one example of an image displayed on the liquid crystal display panel in the liquid crystal display module of the embodiment of the present invention.

FIG. 7 is a view showing one example of an image displayed on the liquid crystal display panel of the liquid crystal display module of this embodiment.

Figure 8:
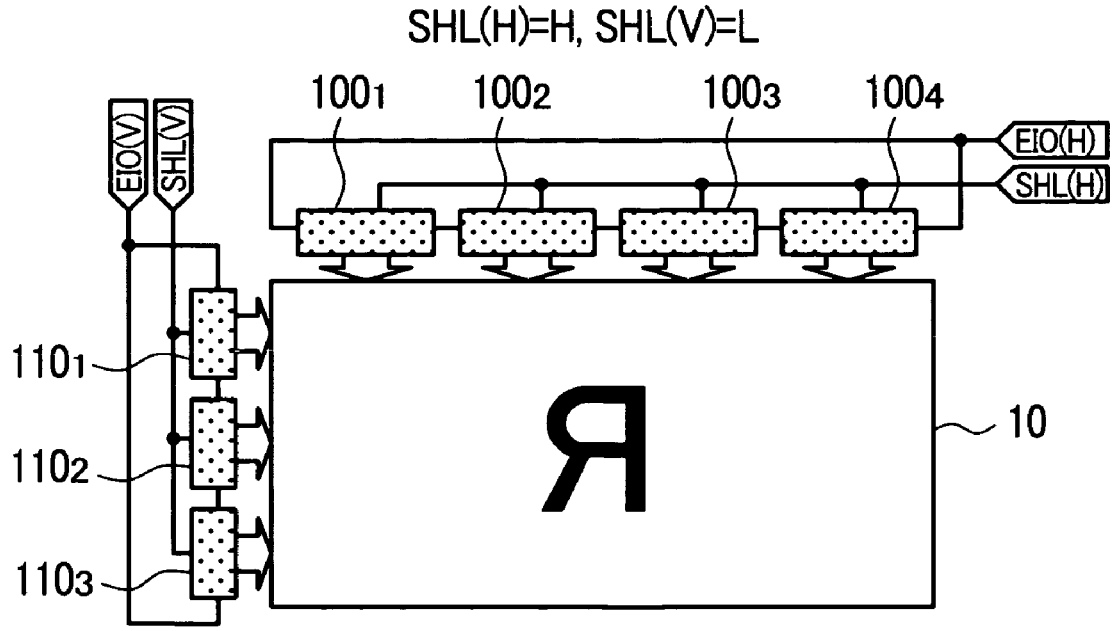
FIG. 8 is a view showing a laterally inverted display image of an image displayed on the liquid crystal display panel shown in FIG. 7 in the liquid crystal display module of the embodiment of the present invention.

FIG. 8 is a view showing a laterally inverted display image of the image displayed on the liquid crystal display panel shown in FIG. 7 in the liquid crystal display module of the embodiment of the present invention.

Figure 9:
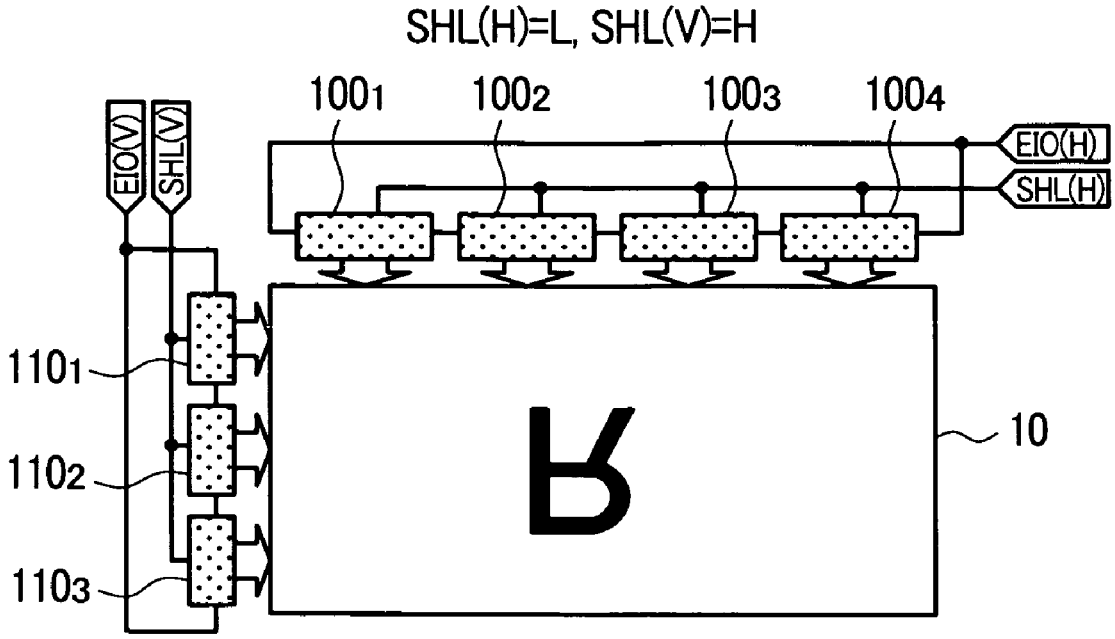
FIG. 9 is a view showing a vertically inverted display image of the image displayed on the liquid crystal display panel shown in FIG. 7 in the liquid crystal display module of the embodiment of the present invention.

FIG. 9 is a view showing a vertically inverted display image of the image displayed on the liquid crystal display panel shown in FIG. 7 in the liquid crystal display module of the embodiment of the present invention.

Figure 10:
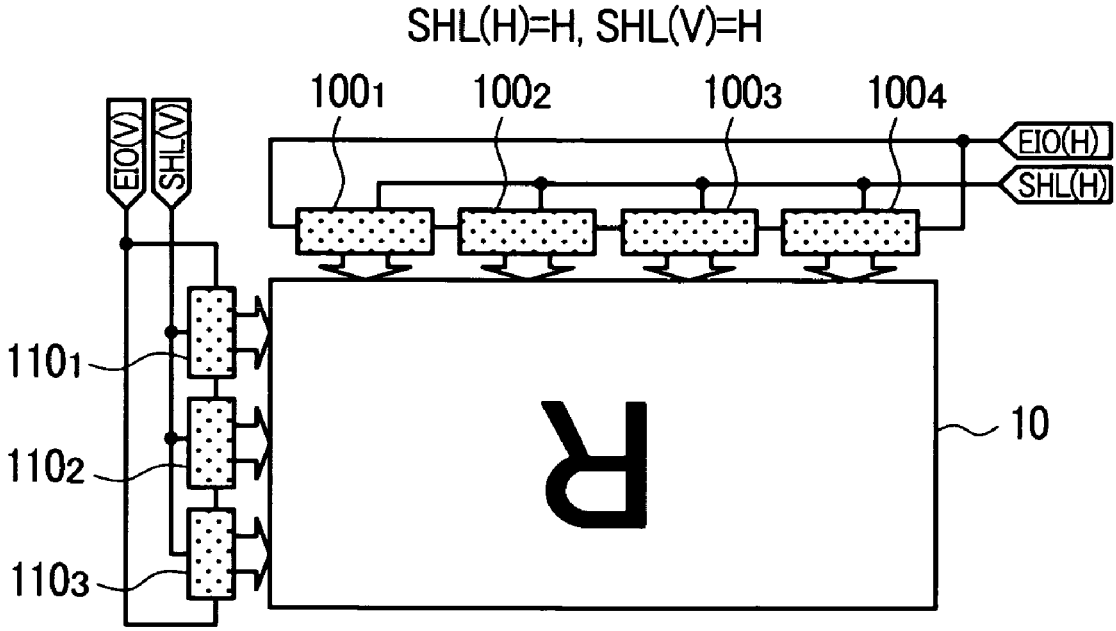
FIG. 10 is a view showing a laterally and vertically inverted display image of the image displayed on the liquid crystal display panel shown in FIG. 7 in the liquid crystal display module of the embodiment of the present invention.

FIG. 10 is a view showing a laterally and vertically inverted display image of the image displayed on the liquid crystal display panel shown in FIG. 7 in the liquid crystal display module of the embodiment of the present invention.

FIG. 7 to FIG. 10 illustrate a case in which the liquid crystal display module includes four drain drivers $\mathbf{100}_1$ to $\mathbf{100}_4$ and three gate drivers $\mathbf{110}_1$ to $\mathbf{110}_3$.

The voltages which are applied to the position designation terminal (LOC1) and the position designation terminal (LOC2) of the respective drain drivers ($\mathbf{100}_1$ to $\mathbf{100}_4$) are set to the voltage levels shown in FIG. 5 and FIG. 6 respectively.

In the same manner, the voltages which are applied to the position designation terminal (LOC1) and the position designation terminal (LOC2) of the respective gate drivers ($\mathbf{110}_1$ to $\mathbf{110}_3$) are also set to the voltage levels shown in FIG. 5 and FIG. 6 respectively.

In such a state, as shown in FIG. 7, by setting a scanning-direction control signal which is applied to a horizontal-scanning-direction changeover terminal (SHL(H)) of the respective drain drivers ($\mathbf{100}_1$ to $\mathbf{100}_4$) to an L level and a scanning-direction control signal which is applied to a vertical-scanning-direction changeover terminal (SHL(V)) of the respective gate drivers ($\mathbf{110}_1$ to $\mathbf{110}_3$) to an L level, an image displayed on the liquid crystal display panel becomes the image shown in FIG. 7.

Further, as shown in FIG. 8, by setting the scanning-direction control signal which is applied to the horizontal-scanning-direction changeover terminal (SHL(H)) of the respective drain drivers ($\mathbf{100}_1$ to $\mathbf{100}_4$) to the H level and the scanning-direction control signal which is applied to the vertical-scanning-direction changeover terminal (SHL(V)) of the respective gate drivers ($\mathbf{110}_1$ to $\mathbf{110}_3$) to the L level, an image displayed on the liquid crystal display panel becomes the laterally inverted display image of the image shown in FIG. 7.

Further, as shown in FIG. 9, by setting the scanning-direction control signal which is applied to the horizontal-scanning-direction changeover terminal (SHL(H)) of the respective drain drivers ($\mathbf{100}_1$ to $\mathbf{100}_4$) to the L level and the scanning-direction control signal which is applied to the vertical-scanning-direction changeover terminal (SHL(V)) of the respective gate drivers ($\mathbf{110}_1$ to $\mathbf{110}_3$) to the H level, an image displayed on the liquid crystal display panel becomes the vertically inverted display image of the image shown in FIG. 7.

Still further, as shown in FIG. 10, by setting the scanning-direction control signal which is applied to the horizontal-scanning-direction changeover terminal (SHL(H)) of the respective drain drivers ($\mathbf{100}_1$ to $\mathbf{100}_4$) to the H level and the scanning-direction control signal which is applied to the vertical-scanning-direction changeover terminal (SHL(V)) of the respective gate drivers ($\mathbf{110}_1$ to $\mathbf{110}_3$) to the H level, an image displayed on the liquid crystal display panel becomes the laterally-and-vertically inverted display image of the image shown in FIG. 7.

As described above, in this embodiment, it is possible to control the miller inversion display in the vertical direction as well as in the lateral direction by merely changing over the voltage level of the scanning-direction control signal which is applied to the horizontal-scanning-direction changeover terminal (SHL(H)) and the voltage level of the scanning-direction control signal which is applied to the vertical-scanning-direction changeover terminal (SHL(V)) and hence, the present invention can cope with various mounting modes of the liquid crystal display panel.

Figure 11:
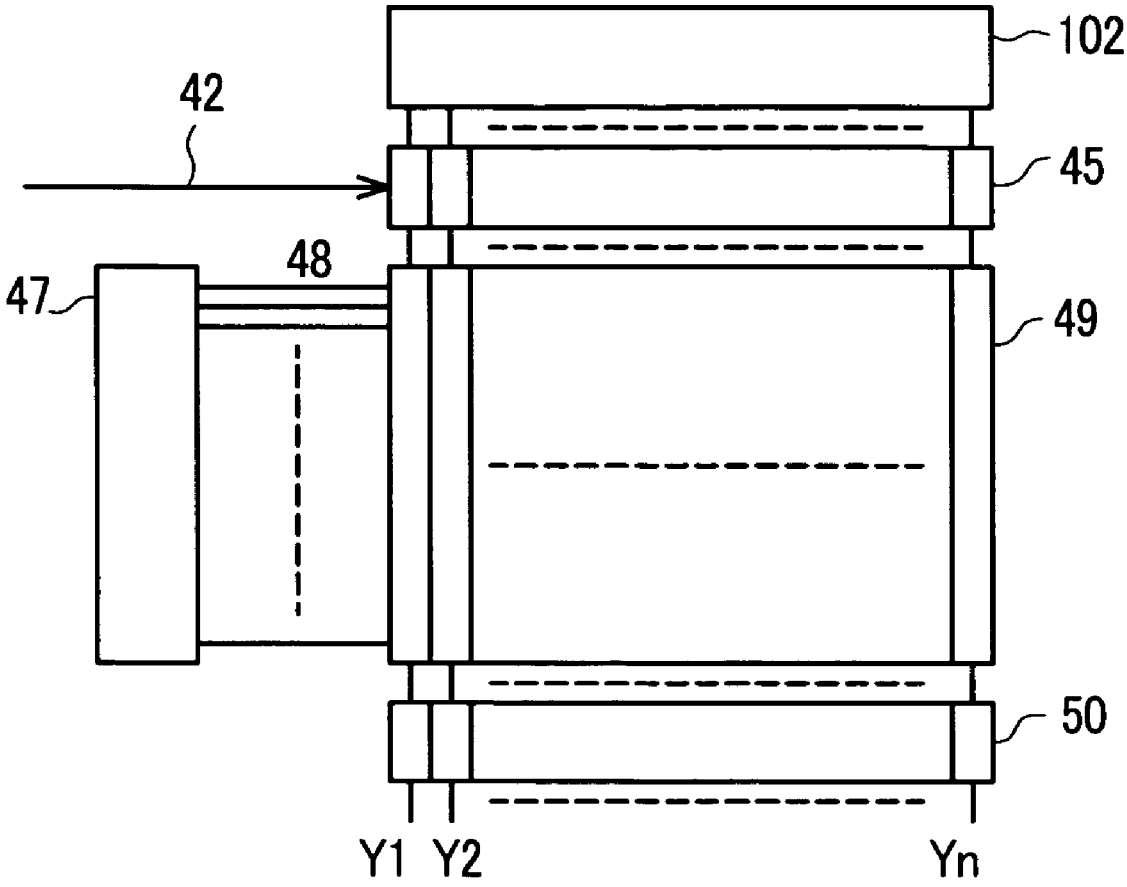
FIG. 11 is a block diagram showing the schematic constitution of one example of an output circuit shown in FIG. 3.
Figure 12:
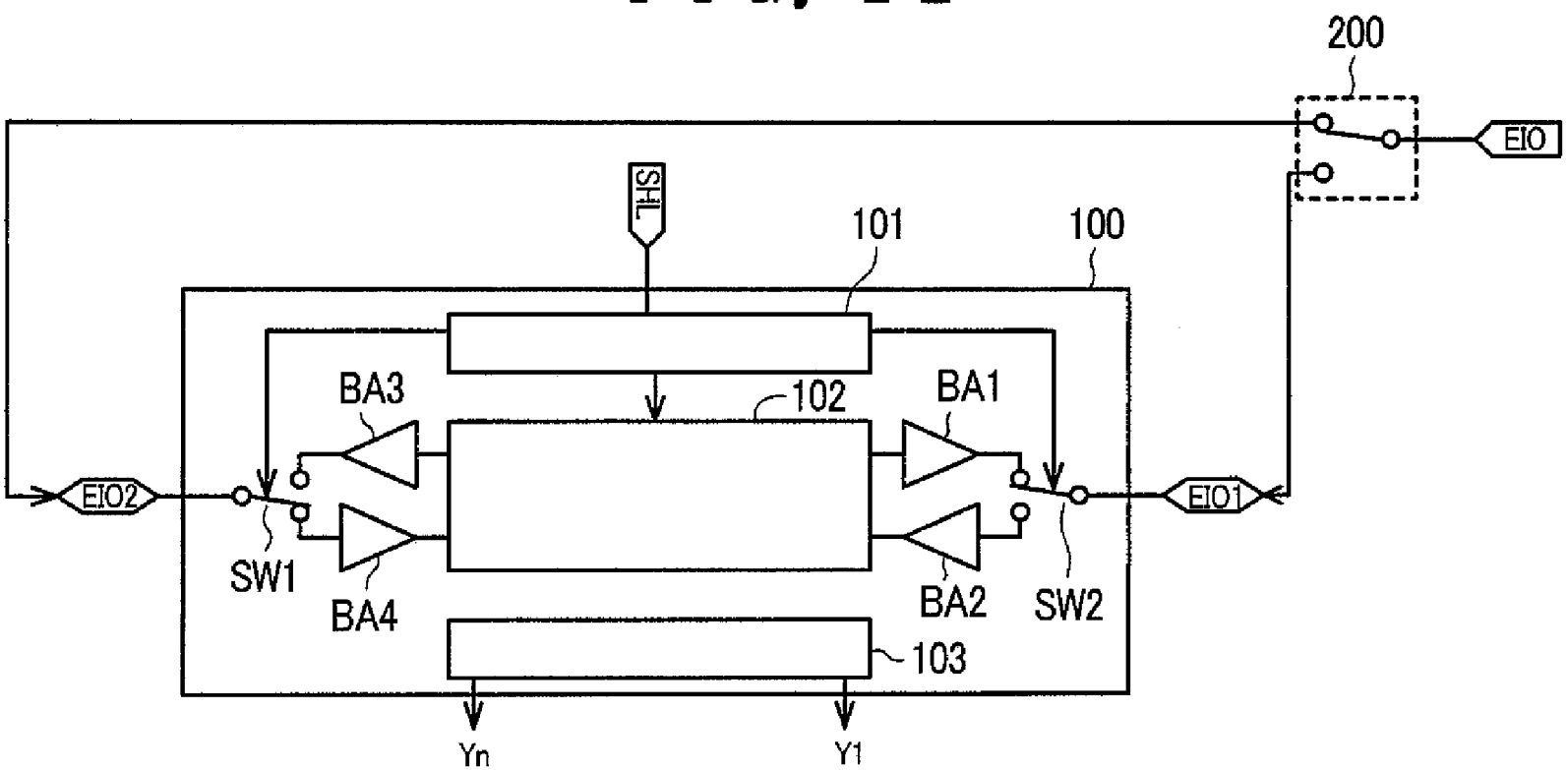
FIG. 12 (Prior Art)
FIG. 12 is a block diagram showing the schematic constitution of one example of a conventional drain driver which possesses a scanning-direction changeover function.

FIG. 11 is a block diagram showing the schematic constitution of one example of an output circuit 103 shown in FIG. 3.

In the output circuit 103 shown in FIG. 11, display data 42 is temporarily stored in a data latch circuit 45 as display data corresponding to one row in response to a display data acquisition pulse supplied from a two-way scanning circuit 102.

On the other hand, a gray scale voltage generating circuit 47 is a circuit which generates a plurality of gray scale voltages 48 necessary for a gray scale display and, for example, the gray scale voltage generating circuit 47 generates sixty-four gray scale voltages 48.

A selector (also referred to as a decoder) 49 selects one gray scale voltage out of the sixty-four gray scale voltages 48 in response to display data which is stored in the data latch circuit 46, outputs the gray scale voltage to the output terminals (Y1 to Yn) by way of an output amplifying circuit 50, and supplies the gray scale voltage to the drain lines (D).

In the output circuit 103 shown in FIG. 11, in response to the above-mentioned changeover of the scanning direction (shift direction) in the two-way scanning circuit 102, the order of display data to be latched by the data latch circuit 46 is changed between the order from the data latch circuit corresponding to the output terminal (Y1) to the data latch circuit corresponding to the output terminal (Yn) and the order from the data latch circuit corresponding to the output terminal (Yn) to the data latch circuit corresponding to the output terminal (Y1).

Here, the above-mentioned explanation is made with respect to the example in which the present invention is applied to the TFT-type liquid crystal display module, the present invention is not limited to such a liquid crystal display module, and the present invention is also applicable to an EL display device which includes organic EL elements.

Although the present invention which is made by the inventors of the present invention has been specifically explained in conjunction with the above-mentioned embodiments, it is needless to say that various modifications are conceivable without departing from the gist of the present invention.

What is claimed is:

1. A display device comprising:

a plurality of pixels; and drive circuits which drive the plurality of pixels;

wherein each drive circuit includes a first input/output terminal, a second input/output terminal, a scanning-direction changeover terminal, and a position designation terminal;

wherein in response to a voltage applied to the position designation terminal and a scanning-direction control signal applied to the scanning-direction changeover terminal, the scanning direction is switchable between the first scanning direction which acquires a start pulse from the first input/output terminal and outputs the start pulse from the second input/output terminal and the second scanning direction which acquires the start pulse from the second input/output terminal and outputs the start pulse from the first input/output terminal;

wherein the position designation terminal includes a first position designation terminal and a second position designation terminal;

wherein the drive circuit, when a first voltage at a first voltage level is applied to the first position designation terminal and the second position designation terminal and a scanning direction control signal applied to the scanning-direction changeover terminal assumes a High level, acquires the start pulse from the first input/output terminal and outputs the start pulse from the second input/output terminal; and wherein the drive circuit, when the first voltage is applied to the first position designation terminal and the second position designation terminal and a scanning direction control signal applied to the scanning-direction changeover terminal assumes a Low level, acquires the start pulse from the second input/output terminal and outputs the start pulse from the first input/output terminal.

2. A display device according to claim 1, wherein each drive circuit includes a scanning control circuit and a two-way scanning circuit;

wherein the scanning control circuit, in response to the voltage applied to the position designation terminal the scanning-direction control signal applied to the scanning direction changeover terminal; and wherein at the time of performing scanning in the first scanning direction, inputs the start pulse which is inputted to the first input/output terminal to the two-way scanning circuit and, at the same time, outputs the start pulse which is scanned in the inside of the two-way scanning circuit from the second input/output terminal, and at the time of performing scanning in the second scanning direction, inputs the start pulse which is inputted to the second input/output terminal to the two-way scanning circuit and, at the same time, outputs the start pulse which is scanned in the inside of the two-way scanning circuit from the first input/output terminal.

3. A display device according to claim 1, wherein in the drive circuit except for the drive circuits which are positioned at both ends among the plurality of the drive circuits, the first voltage is applied to the first position designation terminal and the second position designation terminal;

wherein in the drive circuit which is positioned at a leading end in the first scanning direction among the plurality of drive circuits, the second voltage is applied to the first position designation terminal and, at the same time, the first voltage is applied to the second position designation terminal; and wherein in the drive circuit which is positioned at a leading end in the second scanning direction among the plurality of drive circuits, the first voltage is applied to the first position designation terminal and, at the same time, the second voltage is applied to the second position designation terminal.

4. A display device according to claim 3, wherein the scanning direction of the start pulse assumes the first scanning direction when the scanning-direction control signal assumes the High level, and the scanning direction of the start pulse assumes the second scanning direction when the scanning-direction control signal assumes the Low level.

5. A display device according to claim 1, wherein the display device includes a plurality of video lines which apply a video voltage to the plurality of pixels;

wherein the plurality of drive circuits are formed of a video line drive circuit which sequentially acquires display data inputted from the outside and supplies the video voltage corresponding to the acquired display data to the video lines; and wherein the start pulse is a start pulse for starting the acquisition of the display data.

6. A display device according to claim 1, wherein the display device includes a plurality of scanning lines which apply a selective scanning voltage to the plurality of pixels;

wherein the plurality of drive circuits are formed of a scanning line drive circuit which sequentially supplies the selective scanning voltage to the scanning lines; and wherein the start pulse is a start pulse for starting the selection of the scanning line.

7. A display device according to claim 1, wherein the display device includes a plurality of video lines which apply a video voltage to the plurality of pixels, and a plurality of scanning lines which apply a selective scanning voltage to the plurality of pixels;

wherein the plurality of drive circuits are formed of a video line drive circuit which sequentially acquires display data inputted from the outside and supplies the video voltage corresponding to the acquired display data to the video lines, and a scanning line drive circuit which sequentially supplies the selective scanning voltage to the scanning lines; and wherein the start pulse of the video line drive circuit is a start pulse for starting the acquisition of the display data, and the start pulse of the scanning line drive circuit is a start pulse for starting the selection of the scanning line.

8. A display device comprising:

a plurality of pixels; and drive circuits which drive the plurality of pixels;

wherein each drive circuit includes a first input/output terminal, a second input/output terminal, a scanning-direction changeover terminal and a position designation terminal;

wherein in response to a voltage applied to the position designation terminal and a scanning-direction control signal applied to the scanning-direction changeover terminal, the scanning direction is switchable between the first scanning direction which acquires a start pulse from the first input/output terminal and outputs the start pulse from the second input/output terminal and the second scanning direction which acquires the start pulse from the second input/output terminal and outputs the start pulse from the first input/output terminal;

wherein the position designation terminal includes a first position designation terminal and a second position designation terminal;

wherein the drive circuit, when a second voltage at a second voltage level is applied to the first position designation terminal and, at the same time, a first voltage at a first voltage level is applied to the second position designation terminal, and the scanning-direction control signal applied to the scanning-direction changeover terminal assumes a High level, acquires the start pulse from the first input/output terminal and brings the second input/output terminal into a high impedance state; and wherein the drive circuit, when the second voltage is applied to the first position designation terminal and, at the same time, the first voltage is applied to the second position designation terminal, and the scanning-direction control signal applied to the scanning-direction changeover terminal assumes a Low level, acquires the start pulse from the second input/output terminal and outputs the start pulse from the first input/output terminal.

9. A display device according to claim 8, wherein each drive circuit includes a scanning control circuit and a two-way scanning circuit;

wherein the scanning control circuit, in response to the voltage applied to the position designation terminal the scanning-direction control signal applied to the scanning direction changeover terminal; and wherein at the time of performing scanning in the first scanning direction, inputs the start pulse which is inputted to the first input/output terminal to the two-way scanning circuit and, at the same time, outputs the start pulse which is scanned in the inside of the two-way scanning circuit from the second input/output terminal, and at the time of performing scanning in the second scanning direction, inputs the start pulse which is inputted to the second input/output terminal to the two-way scanning circuit and, at the same time, outputs the start pulse which is scanned in the inside of the two-way scanning circuit from the first input/output terminal.

10. A display device according to claim 8, wherein the display device includes a plurality of video lines which apply a video voltage to the plurality of pixels;

wherein the plurality of drive circuits are formed of a video line drive circuit which sequentially acquires display data inputted from the outside and supplies the video voltage corresponding to the acquired display data to the video lines; and wherein the start pulse is a start pulse for starting the acquisition of the display data.

11. A display device according to claim 8, wherein the display device includes a plurality of scanning lines which apply a selective scanning voltage to the plurality of pixels;

wherein the plurality of drive circuits are formed of a scanning line drive circuit which sequentially supplies the selective scanning voltage to the scanning lines; and wherein the start pulse is a start pulse for starting the selection of the scanning line.

12. A display device according to claim 8, wherein the display device includes a plurality of video lines which apply a video voltage to the plurality of pixels, and a plurality of scanning lines which apply a selective scanning voltage to the plurality of pixels;

wherein the plurality of drive circuits are formed of a video line drive circuit which sequentially acquires display data inputted from the outside and supplies the video voltage corresponding to the acquired display data to the video lines, and a scanning line drive circuit which sequentially supplies the selective scanning voltage to the scanning lines; and wherein the start pulse of the video line drive circuit is a start pulse for starting the acquisition of the display data, and the start pulse of the scanning line drive circuit is a start pulse for starting the selection of the scanning line.

13. A display device comprising:

a plurality of pixels; and drive circuits which drive the plurality of pixels;

wherein each drive circuit includes a first input/output terminal, a second input/output terminal, a scanning-direction changeover terminal, and a position designation terminal;

wherein in response to a voltage applied to the position designation terminal and a scanning-direction control signal applied to the scanning-direction changeover terminal, the scanning direction is switchable between the first scanning direction which acquires a start pulse from the first input/output terminal and outputs the start pulse from the second input/output terminal and the second scanning direction which auguries the start pulse from the second input/output terminal and outputs the start pulse from the first input/output terminal;

wherein the position designation terminal includes a first position designation terminal and a second position designation terminal;

wherein the drive circuit, when a first voltage at a first voltage level is applied to the first position designation terminal and, at the same time, a second voltage at a second voltage level is applied to the second position designation terminal, and the scanning-direction control signal applied to the scanning-direction changeover terminal assumes a High level, acquires the start pulse from the first input/output terminal and outputs the start pulse from the second input/output terminal; and wherein the drive circuit, when the first voltage is applied to the first position designation terminal and, at the same time, the second voltage is applied to the second position designation terminal, and the scanning-direction control signal applied to the scanning-direction changeover terminal assumes a Low level, acquires the start pulse from the second input/output terminal and brings the first input/output terminal into a high impedance state.

14. A display device according to claim 13, wherein each drive circuit includes a scanning control circuit and a two-way scanning circuit;

wherein the scanning control circuit, in response to the voltage applied to the position designation terminal the scanning-direction control signal applied to the scanning direction changeover terminal; and wherein at the time of performing scanning in the first scanning direction, inputs the start pulse which is inputted to the first input/output terminal to the two-way scanning circuit and, at the same time, outputs the start pulse which is scanned in the inside of the two-way scanning circuit from the second input/output terminal, and at the time of performing scanning in the second scanning direction, inputs the start pulse which is inputted to the second input/output terminal to the two-way scanning circuit and, at the same time, outputs the start pulse which is scanned in the inside of the two-way scanning circuit from the first input/output terminal.

15. A display device according to claim 13, wherein the display device includes a plurality of video lines which apply a video voltage to the plurality of pixels;

wherein the plurality of drive circuits are formed of a video line drive circuit which sequentially acquires display data inputted from the outside and supplies the video voltage corresponding to the acquired display data to the video lines; and wherein the start pulse is a start pulse for starting the acquisition of the display data.

16. A display device according to claim 13, wherein the display device includes a plurality of scanning lines which apply a selective scanning voltage to the plurality of pixels;

wherein the plurality of drive circuits are formed of a scanning line drive circuit which sequentially supplies the selective scanning voltage to the scanning lines; and wherein the start pulse is a start pulse for starting the selection of the scanning line.

17. A display device according to claim 13, wherein the display device includes a plurality of video lines which apply a video voltage to the plurality of pixels, and a plurality of scanning lines which apply a selective scanning voltage to the plurality of pixels;

wherein the plurality of drive circuits are formed of a video line drive circuit which sequentially acquires display data inputted from the outside and supplies the video voltage corresponding to the acquired display data to the video lines, and a scanning line drive circuit which sequentially supplies the selective scanning voltage to the scanning lines; and wherein the start pulse of the video line drive circuit is a start pulse for starting the acquisition of the display data, and the start pulse of the scanning line drive circuit is a start pulse for starting the selection of the scanning line.

* * * * *